US010549882B2

(12) United States Patent
Thielen et al.

(10) Patent No.: US 10,549,882 B2
(45) Date of Patent: Feb. 4, 2020

(54) CAN LID

(71) Applicant: Gregor Anton Piech, Salzburg (AT)

(72) Inventors: Klaus Thielen, Schönau am Königssee (DE); Eva-Maria Thielen, Schönau am Königssee (DE)

(73) Assignee: Gregor Anton Piech, Ebbs (AT)

( * ) Notice: Subject to any disclaimer, the term of this patent is extended or adjusted under 35 U.S.C. 154(b) by 173 days.

(21) Appl. No.: 15/542,828

(22) PCT Filed: Nov. 10, 2016

(86) PCT No.: PCT/EP2016/077249
§ 371 (c)(1),
(2) Date: Jul. 11, 2017

(87) PCT Pub. No.: WO2017/108260
PCT Pub. Date: Jun. 29, 2017

(65) Prior Publication Data

US 2018/0002065 A1 Jan. 4, 2018

(30) Foreign Application Priority Data

Dec. 22, 2015 (DE) ..... 10 2015 122 548

(51) Int. Cl.
*B65D 17/28* (2006.01)
*B65D 25/14* (2006.01)

(52) U.S. Cl.
CPC ..... *B65D 17/4012* (2018.01); *B65D 17/404* (2018.01); *B65D 25/14* (2013.01); *B65D 2517/0014* (2013.01); *B65D 2517/0016* (2013.01); *B65D 2517/0082* (2013.01)

(58) Field of Classification Search
CPC ... B65D 17/4012; B65D 17/404; B65D 25/14
USPC ..... 220/269, 270, 273, 272, 268
See application file for complete search history.

(56) References Cited

U.S. PATENT DOCUMENTS 3,342,367 A 9/1967 Irland
3,952,912 A * 4/1976 Perry ..... B21D 51/383 220/269
3,964,670 A 6/1976 Amneus
(Continued)

FOREIGN PATENT DOCUMENTS

DE 2950512 T5 12/1979
DE 19629148 A1 1/1998
(Continued)

*Primary Examiner* — Jeffrey R Allen
(74) *Attorney, Agent, or Firm* — Vivacqua Law PLLC

(57) ABSTRACT

A can lid is described that is in particular intended for beverage cans and that differs from the generally known metallic can lids in that the opening region is configured as a tongue tab that is separated from the lid surface by a microgap, in particular a punched gap, extending over the tab periphery and the tongue tab base connected to the lid surface forms a kink bearing that becomes effective on the opening procedure and that is connected to the lid surface, and in that the lower side of the metallic lid is in particular coated over its whole surface in a firmly adhering manner with a plastic material, in particular a plastic film, and this coating is weakened, in particular notched, adjacent to the microgap between the tongue tab and the lid surface.

22 Claims, 3 Drawing Sheets

(56) References Cited

U.S. PATENT DOCUMENTS

| | | | | |
|---|---|---|---|---|
| 4,533,063 | A * | 8/1985 | Buchner | B65D 3/22 220/270 |
| 4,802,603 | A * | 2/1989 | Schmidt | B65D 17/401 220/268 |
| 10,273,063 | B2 | 4/2019 | Schandl | |
| 2011/0052459 | A1 | 3/2011 | Shibata et al. | |
| 2012/0022214 | A1 | 1/2012 | Davis et al. | |
| 2012/0043325 | A1 | 2/2012 | Williams et al. | |
| 2013/0037543 | A1 | 2/2013 | McClung et al. | |

FOREIGN PATENT DOCUMENTS

| | | | |
|---|---|---|---|
| DE | 69606050 | T2 | 7/1998 |
| EP | 648680 | A1 | 4/1995 |
| WO | 2015/104659 | A1 | 7/2015 |

* cited by examiner

CAN LID

CROSS REFERENCE TO RELATED APPLICATIONS

This application is a national stage application under 35 U.S.C. 371 of PCT Application No. PCT/EP2016/077249 having an international filing date of 10 Nov. 2016, which PCT application claimed the benefit of German Patent Application No. 10 2015 122548.4 filed 22 Dec. 2015, the entire disclosure of each of which are hereby incorporated herein by reference.

TECHNICAL FIELD

The invention relates to a can lid, in particular for beverage cans, having a bounded opening region provided in the metallic lid material of a lid surface, and having a two-armed lever member that is intended to open this opening region and that is firmly connected to the lid material, in particular via a rivet connection or a weld connection.

INTRODUCTION

Can lids of this kind are used to an extremely large degree all over the world. They can be manufactured simply and inexpensively and allow a space-saving stacking of cans as well as an opening of the cans by a simple upward pivoting of the long arm of the lever member. However, these generally known can lids have serious disadvantages that above all comprise the fact that the lever part that first lies flat on the lid surface is not easy to grip, that the partial lid region first closing the opening region is pressed into the interior of the can on the upward pivoting of the lever member and on the opening of the can that takes place in so doing and there comes into contact with the liquid, which is not hygienically unobjectionable, and in that tiny aluminum particles are unavoidable released from the lid material and also move directly or over the partial lid region pressed into the interior of the can during the opening procedure, i.e. when the weakening groove present between the opening region and the lid surface is torn open or is separated. These tiny splinters or aluminum particles are critical in a health respect when they enter into the human body together with the beverage.

SUMMARY

It is the object of the present invention to provide a can lid of the initially named kind without at least one of the above-named disadvantages, i.e. in particular to provide a can lid that can be opened with a considerably smaller exertion of force and more easily in handling in comparison with the conventional can lids, that is hygienically unobjectionable and that above all precludes the occurrence of aluminum splinters or aluminum microparticles during the opening procedure. A can provided with the lid in accordance with the invention should otherwise corresponds to the conventional cans with respect to the storage of the respective contents and with respect to the production properties, transport properties and handling properties.

This object is substantially satisfied in accordance with a first embodiment of the invention in that the opening region is configured as a tongue tab that is separated from the lid surface by a microgap, in particular a punched gap, extending over the tab periphery, that forms a kink bearing that becomes effective on the opening procedure and that is connected to the lid surface, and in that the lower side of the metallic lid is in particular coated over its whole surface in a firmly adhering manner with a plastic material, in particular with a plastic film, and this coating is weakened, in particular notched, and preferably at least partly notched open, adjacent to the microgap between the tongue tab and the lid surface.

The interaction between the provided microgap and the plastic film provided at the lower lid side is of particular importance in this embodiment of the invention, said plastic film being weakened or notched adjacent to the microgap between the tongue tab and the lid surface such that, on the one hand, the opening of the can is possible with a surprisingly small force via the two-armed lever and, on the other hand, the demands on the leak-tightness of the can is nevertheless reliably ensured. The microgap is in this respect preferably obtained by a punching procedure with a subsequent return of the tongue tab pressed out of the can lid material by the punching back into its starting position before the punching. The simple opening, i.e. possible with small force, of the can is a consequence of the fact that no cutting through of metal is necessary and the film at the lower side is only peeled off in a very narrow region during the opening due to the notching.

In accordance with an aspect of the above basic principle of the interaction of the microgap and the plastic coating provided at the lower lid side, the two-armed lever member is fastened to the lid surface and the short lever arm pivots the tongue tab into the interior of the can together with the partial region of the plastic coating covering it at the lower side and bounded by the weakening line during the opening procedure, with this being made possible in that the notch line is disposed outside the microgap.

Any disturbing splinter formation during the opening procedure is thus precluded and an opening of the can possible with a smaller force is ensured.

A preferred further development of the basic principle in accordance with the invention comprises the two-armed lever member being fastened to the tongue tab and its short lever arm being supportable on the lid surface, in particular on a stiffening region of the lid surface and the long lever arm outwardly pivoting the tongue tab together with the partial region of the plastic coating covering it at the lower side and bounded by the weakening line arranged within the microgap during the opening procedure.

This embodiment combines all the achievable advantages of the invention within itself since the opening procedure requires a considerably smaller force exertion in comparison with the conventional can lids, since the occurrence of aluminum splinters or aluminum microparticles is completely avoided during the opening procedure, and in addition an optimum with respect to the hygienic aspect is achieved since an immersion of can lid particles into the interior can space and thus into the liquid located in the can is avoided.

An aspect of the invention advantageous for all the embodiment variants is characterized in that the tongue tab of the metallic can lid is separated from the lid surface surrounding it while forming mutually engaging projections and recesses by a cutting process, in particular by a punching process, and in that the tongue tab and the lid surface adjacent thereto are connected in a shape-matched and force-transmitting manner while forming the microgap via the projections and recesses, wherein the leak-tightness of the finished, unopened can lid is ensured by the inwardly disposed plastic coating or film. The sealing capacity with respect to the internal can pressure is improved by a concave design of the tongue tab.

The projections and the recesses are preferably coupled via undercuts.

In particular in the embodiment variant in which the tongue tab is outwardly moved during the opening process, the longer arm of the two-armed lever member is formed by a gripping tab, in particular by a ring tab, and the two-armed lever member is connected to the tongue tab off-center, in particular at the marginal side.

In addition to the can lids described in detail, the invention also comprises all the cans that are provided with a can lid in accordance with the invention, said can lid preferably being connected to the respective can via a respective bead rim, wherein the plastic film provided at the lower can side in particular takes over the sealing function between the can lid and the can and the directly positioned notch enables the opening with a small force.

BRIEF DESCRIPTION OF THE DRAWINGS

A preferred embodiment of the invention will be explained in the following with reference to the drawings; there are shown in the drawings.

DETAILED DESCRIPTION

Figure 1:
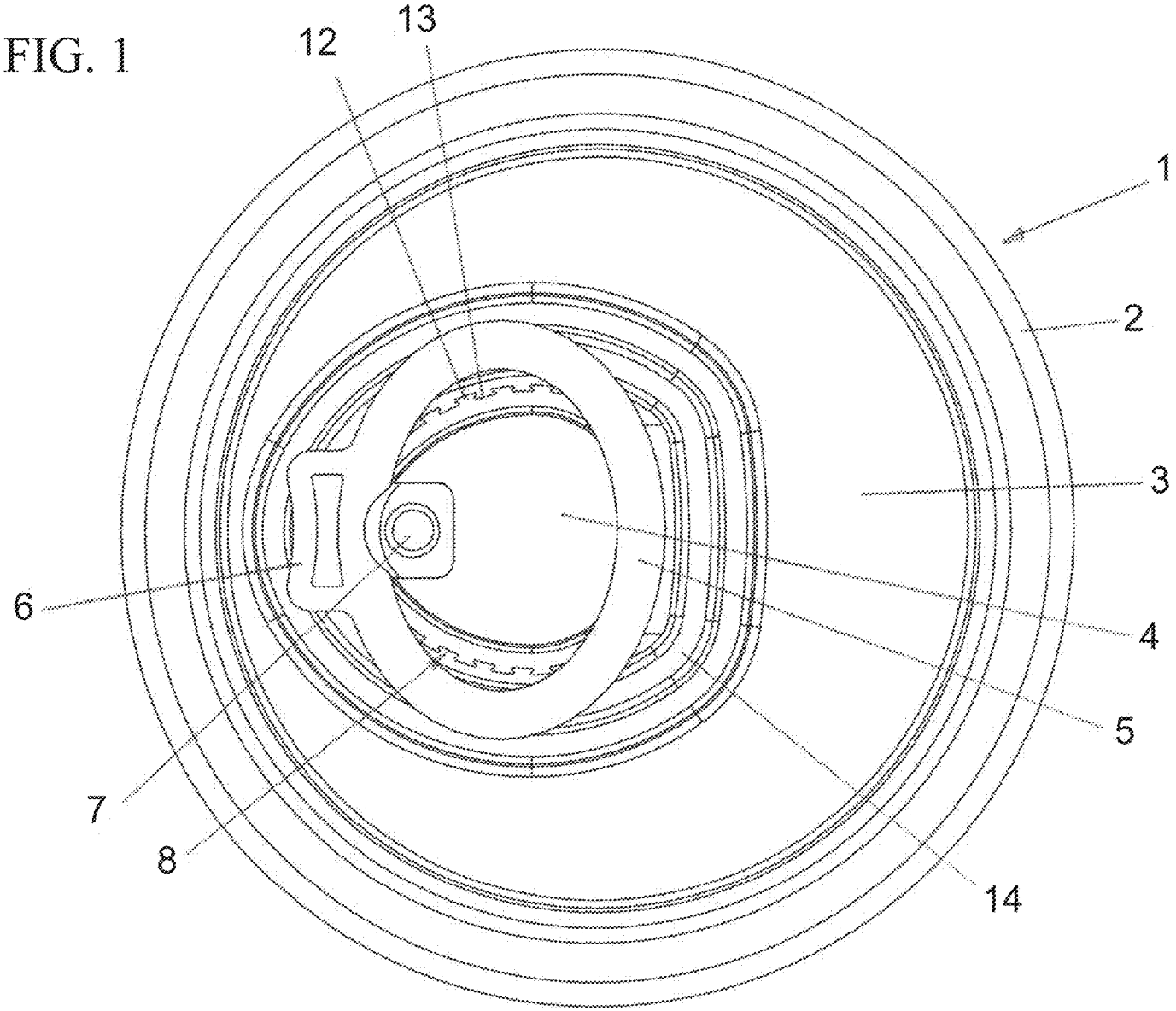
FIG. 1 is a schematic plan view of a can lid in the closed state.
Figure 2:
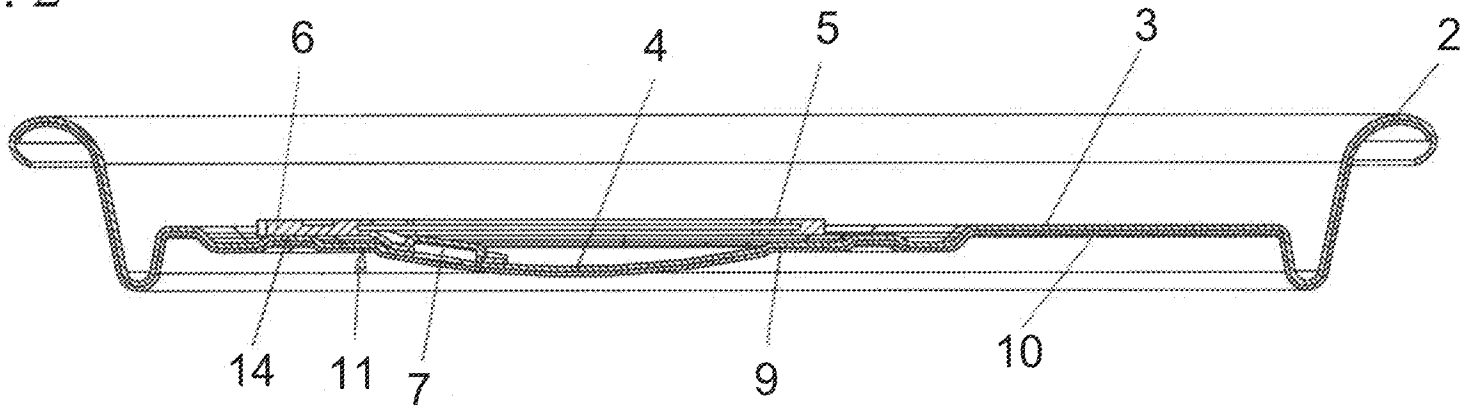
FIG. 2 is a sectional representation along a diameter of the can lid in accordance with FIG. 1.

FIG. 1 shows an embodiment of the can lid 1 in accordance with the invention in a schematic plan view. This can lid is provided at its peripheral region with a bead rim 2 in a conventional manner, wherein the region disposed within the bead rim 2 is formed by a lid surface 3 that is offset with respect to the center and that has an opening region 4 formed as a tongue tab. This metallic can lid comprising aluminum material is provided in a manner surrounding the opening region 4 with a stiffening region 14 formed by material deformation.

A two-armed lever 5, 6 is connected, in particular riveted or welded, to the opening region 4 or to the tongue tab of the can lid such that a fixed connection point 7 results. This connection point 7 is disposed in the marginal region of the opening region 4, i.e. opposite the tongue base connected to the lid surface 3 and the two-armed lever comprises a shorter region and a longer region, wherein the longer region is preferably formed by an easily grippable ring tab 5 and the shorter region is formed by a supporting limb 6 that is supported on a part of the stiffening region 14 of the can lid on the upward pivoting of the longer lever. The two-armed lever 5, 6 lies substantially in parallel with the lid surface 3 in the starting state.

The tongue tab forming the opening region 4 is connected in a shape-matched and force-transmitting manner to the lid surface 3 via projections 12 and recesses 13 and preferably via suitable undercuts of these parts, and indeed with the exception of the region of the tongue base 7 where the opening region 4 and the lid surface 3 are connected in a metallic manner such that an upward pivoting of the tongue tab 3 is made possible by means of the lever practically via a kind of folding joint 9 on the opening of the can and the tongue tab and the lever can then move into a position of rest outside the inner can space while releasing the opening.

The required leak-tightness of the can lid is ensured despite the lack of a continuous metallic connection between the lid surface 3 and the opening region 4 in the region of the toothed arrangement by a plastic material, in particular a suitable plastic film that is in particular attached over the whole surface to the lower side of the metallic lid and that is attached or sealed to the lower lid side in a firmly adhering manner. The coating has a pronounced weakening 14, in particular a notch or partial opening notch, directly adjacent to and within the opening line or the microgap such that on the opening of the can lid and on the pulling up of the tongue tab 4, the narrow region of the plastic film covering the microgap is practically peeled off from the material and thus an opening of the can is made possible that takes place with a small exertion of force.

To achieve this design that precludes any formation of metal splinters on the opening of the can lid, the opening region or the tongue tab is separated from the surrounding lid surface by a cutting procedure or preferably by a punching procedure in the production of the can lid, wherein the splinters or microparticles that are thereby produced can be eliminated completely and without problem as part of the production process. The tongue tab that is still connected to its base by the lid surface 3 is pressed back into the lid surface plane directly after its punching out such that the original appearance practically results for the lid surface, but now with a microgap produced by the punching procedure.

Mutually engaging projections 12 and recesses 13 are preferably produced instead of a linear microgap, such as can be seen from FIG. 1.

In this case, the two initially partly separated components are again joined to one another in a shape-matched manner directly after the punching procedure such that the can lid can be treated in further production steps in the same way as conventional can lids that only have a weakening groove.

The processes of separating and joining together take place directly after one another, i.e. after the punching stroke the shape-matched joining together of both parts to form a total part takes place in the return stroke. The shape-matched and force-transmitting connection between the two regions is achieved by a suitable shaping or by using undercuts that ensures a sufficient mutual mechanical connection such that the required coating procedures or the process of the application of the film to the lower side can also be carried out as with a uniform part.

Instead of the toothed arrangement shown in the drawing, different, optionally simpler, gap line extents can be provided in accordance with the invention in the punching procedure, wherein, however, the opening region or the tongue tab in every case remains connected to the lid surface 3 via the kink bearing region 9 and the microgap is covered by the plastic film disposed at the inner side and provided with a notch. The plastic film, which can be an PP film and which reacts with the sealing wax provided at the metal during sealing, is in particular manufactured as a separate molded blister part in which the notch is already provided. If the film has a thickness e.g. of approximately $2/10$ mm, a weakening to $1/100$ mm takes place in the notch.

Figure 3:
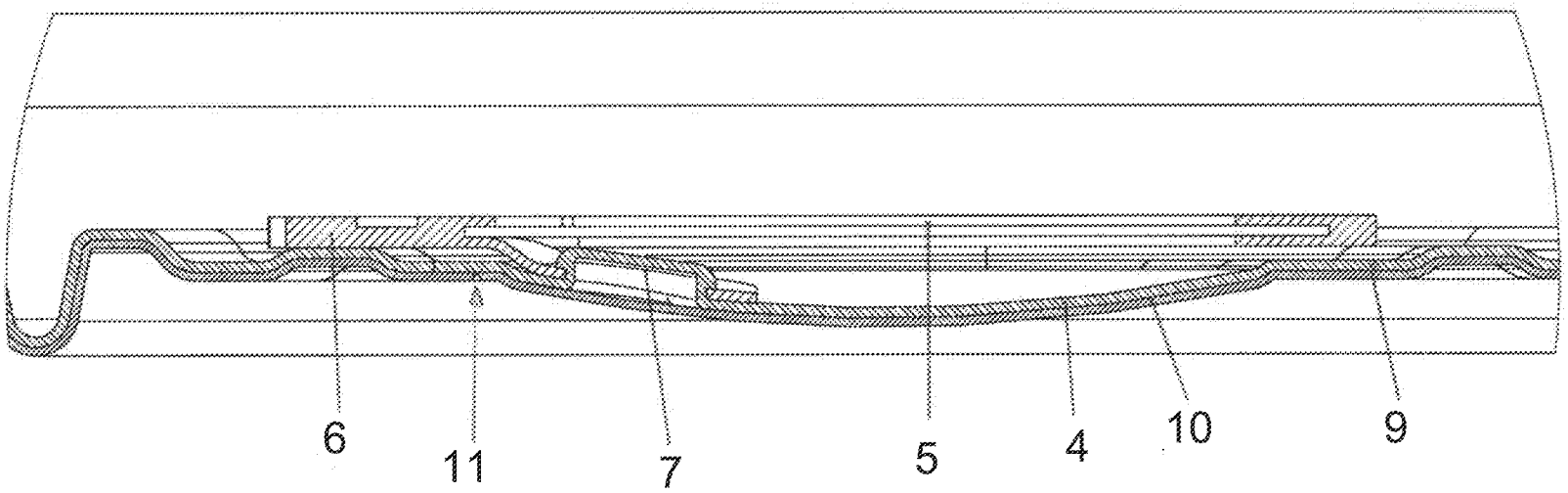
FIG. 3 is an enlarged partial representation of the sectional view in accordance with FIG. 2.

The somewhat enlarged part representation in accordance with FIG. 3 above all shows, in addition to the embodiment of the connection point 7 in the manner of a rivet connection, the application of the plastic film 10 over the full surface to the lower side of the can lid and in particular the formation of the weakening line 11 in the plastic film 10 preferably achieved by a notching and/or regionally by a notching open, said plastic film extending within or outside the microgap about the opening region 4 depending on the embodiment.

Figure 4:
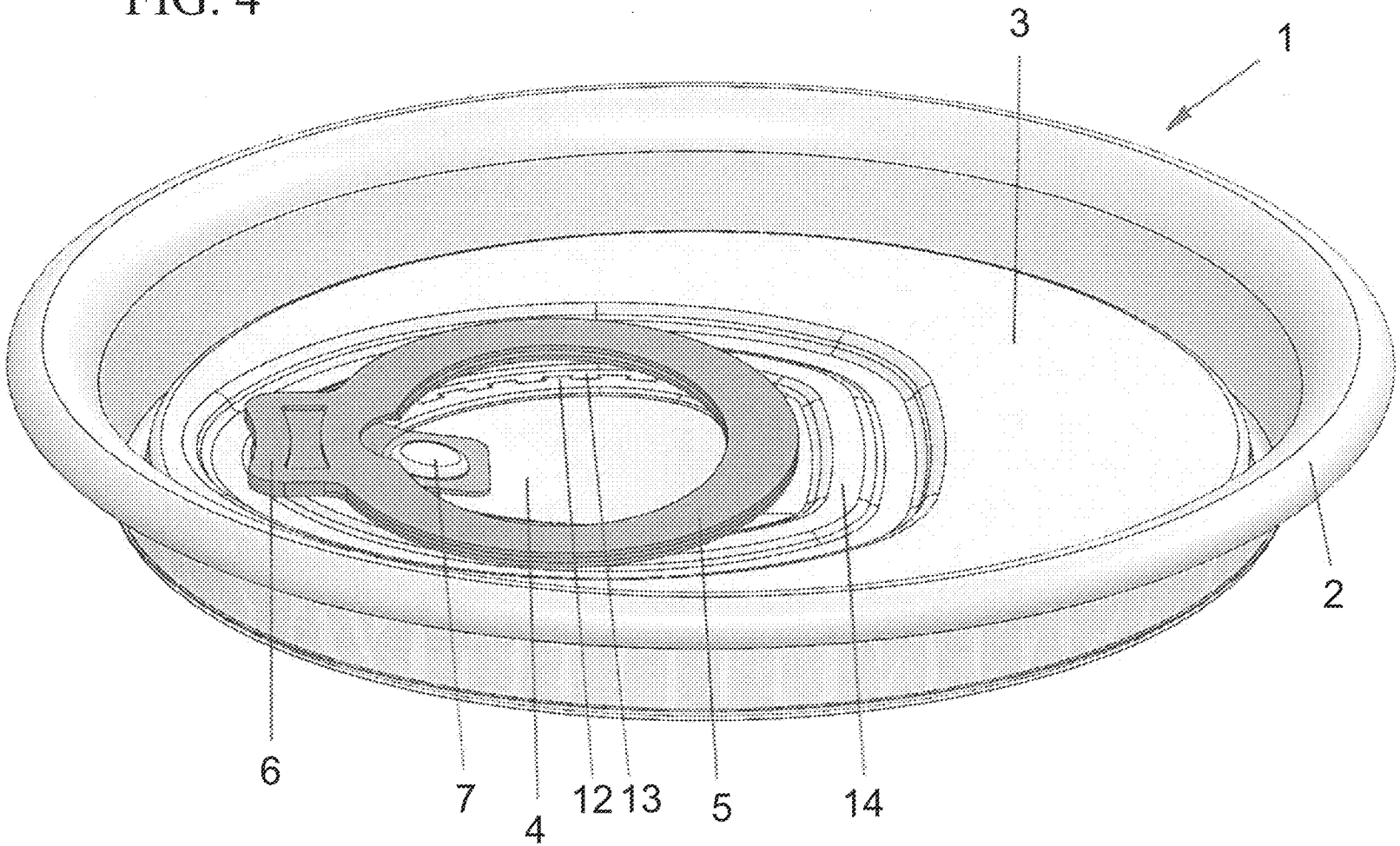
FIG. 4 is a perspective oblique view of the can lid from above.

The perspective representation in accordance with FIG. 4 shows the already described design features in a particular illustrative manner and also allows it to be recognized that the ring tab 5 forming the longer lever arm can be easily gripped around by one finger due to a cut-out provided in the lid surface 3 and can be upwardly pivoted for the opening procedure. On this upward pivoting of the gripping tab 5, the shorter lever 6 is supported at the stiffened region 14, whereby the opening region 4 is opened in the course of the pulling up of the ring tab with a simultaneous release, now taking place without splinter formation, of the in particular shape-matched coupling of the lid surface 3 and the tongue tab 4 and the can is opened while separating and releasing the plastic film present at the lower side of the lid.

The ring tab 5 and the opening region 3 pulled up with it are pivoted into the free right-hand region of the lid cover via the kink bearing region 9 disposed beneath the free end of the ring tab in FIG. 4 and remain there with an open can.

As described, in this manner, all the disadvantages of the previously known and widespread can lid are avoided, in particular and above all the formation hazardous to the health of tiny aluminum microparticles on the can opening. It is of particular importance in this respect that all these advantages are obtained without any substantial additional technical production effort.

The closing and opening system described for a can lid can also be used in an analog manner for other containers and packages that are to be equipped with a tear closure.

REFERENCE NUMERAL LIST

1 can lid
2 bead rim
3 lid surface
4 opening region, tongue tab
5 lever arm
6 lever arm
7 fastening point, tongue base
8 microgap
9 kink bearing region
10 plastic film
11 weakening line, notch
12 projection
13 recess
14 stiffening region

The invention claimed is:

1. A can lid, comprising a bounded opening region provided in a metallic lid material of a lid surface of the can lid;

and a two-armed lever member intended for opening this opening region, said lever member being fixedly connected to said metallic lid material, wherein the bounded opening region is configured as a tongue tab that is separated from the lid surface by a microgap extending over a tab periphery such that the tongue tab is not larger than the opening region in the lid surface, and wherein a tongue tab base connected to the lid surface forms a kink bearing that becomes effective during the opening procedure; and wherein a lower side of the can lid is coated with a plastic material in a firmly adhering manner, and this coating is weakened along a weakening line defined in the coating adjacent to the microgap between the tongue tab and the lid surface.

2. The can lid in accordance with claim 1, wherein the two-armed lever member comprises a long lever arm and short lever arm, wherein the two-armed lever member is fastened to the lid surface and the short lever arm thereof pivots the tongue tab into the interior of the can during the opening procedure together with the part region of the plastic coating covering it at the lower side and bounded by a weakening line, with the weakening line being disposed outside the microgap.

3. The can lid in accordance with claim 1, wherein the two-armed lever member comprises a long lever arm and a short lever arm, wherein the two-armed lever member is fastened to the tongue tab and the short lever arm thereof can be supported on the lid surface; and wherein the long lever arm of the two-armed lever member pivots the tongue tab outwardly during the opening procedure together with the part region of the plastic coating covering it at the lower side and bounded by a weakening line, with the weakening line being disposed within the microgap.

4. The can lid in accordance with claim 1, wherein the tongue tab of the can lid is separated from the lid surface surrounding it while forming mutually engaging projections and recesses by a cutting procedure; and wherein the tongue tab and the lid surface adjoining it are connected subsequent to the cutting procedure in a shape-matched and force-transmitting manner via the projections and the recesses while forming the microgap by a pressing process, with the leak-tightness of the finished, unopened can lid being ensured by the inwardly disposed plastic coating or film.

5. The can lid in accordance with claim 4, wherein the projections and the recesses are coupled via undercuts.

6. The can lid in accordance with claim 4, wherein the lid surface is formed in a concave manner in the region of the tongue tab and sealing capacity in the microgap is increased by the internal container pressure.

7. The can lid in accordance with claim 1, wherein the plastic film provided at the lower side forms a separate molded blister part prior to its sealing to the lower side and the weakening line is already provided in said molded blister part.

8. The can lid in accordance with claim 3, wherein the two-armed lever member is connected to the tongue tab off-center.

9. The can lid in accordance with claim 8, wherein the long lever arm of the two-armed lever member is formed by a gripping tab.

10. A can having a can lid, the can lid comprising a bounded opening region provided in a metallic lid material of a lid surface of the can lid;

and a two-armed lever member intended for opening this opening region, said lever member being fixedly connected to said metallic lid material, wherein the bounded opening region is configured as a tongue tab that is separated from the lid surface by a microgap extending over a tab periphery such that the tongue tab is not larger than the opening region in the lid surface, and wherein a tongue tab base connected to the lid surface forms a kink bearing that becomes effective during the opening procedure; and wherein a lower side of the can lid is coated with a plastic material in a firmly adhering manner, and this coating is weakened adjacent to the microgap between the tongue tab and the lid surface;

wherein the can lid is connected to the can via a marginal rim.

11. The can lid in accordance with claim 1 that is configured for beverage cans.

12. The can lid in accordance with claim 1, wherein said lever member is fixedly connected to said metallic lid material via one of a rivet connection and a weld connection.

13. The can lid in accordance with claim 1, wherein the microgap is a punched gap.

14. The can lid in accordance with claim 1 wherein the lower side of the can lid is coated over its full surface with a plastic material.

15. The can lid in accordance with claim 1, wherein the lower side of the can lid is coated with a plastic film.

16. The can lid in accordance with claim 1, wherein the coating is notched.

17. The can lid in accordance with claim 16, wherein the coating is at least partly notched open adjacent to the microgap between the tongue tab and the lid surface.

18. The can lid in accordance with claim 3, wherein the short lever arm can be supported on a stiffening region of the lid surface.

19. The can lid in accordance with claim 4, wherein said mutually engaging projections and recesses are formed by a punching procedure.

20. The can lid in accordance with claim 4, wherein the plastic coating or film has a thickness in the range from approximately 1/10 mm to 3/10 mm.

21. The can lid in accordance with claim 8, wherein the two-armed lever member is connected to the tongue tab at a marginal side.

22. The can lid in accordance with claim 9, wherein the long lever arm of the two-armed lever member is formed by a ring tab.

* * * * *